US006666775B2

(12) United States Patent
Jäger

(10) Patent No.: US 6,666,775 B2
(45) Date of Patent: Dec. 23, 2003

(54) PIN FOR NINEPINS AND BOWLING

(75) Inventor: Arnold Jäger, Burgdorf (DE)

(73) Assignee: Gummi-Jäger KG GmbH & Cie. (DE)

( * ) Notice: Subject to any disclaimer, the term of this patent is extended or adjusted under 35 U.S.C. 154(b) by 0 days.

(21) Appl. No.: 10/072,673

(22) Filed: Feb. 8, 2002

(65) Prior Publication Data

US 2002/0115493 A1 Aug. 22, 2002

(30) Foreign Application Priority Data

Feb. 8, 2001 (DE) ..... 101 06 101

(51) Int. Cl.[7] ..... A63D 9/00
(52) U.S. Cl. ..... 473/119; 473/124
(58) Field of Search ..... 473/119, 124

(56) References Cited

U.S. PATENT DOCUMENTS 1,088,937 A * 3/1914 Schlag
1,821,037 A * 9/1931 Souder
2,195,687 A * 4/1940 Walker
2,479,003 A * 8/1949 Clark
2,739,814 A * 3/1956 Downey

* cited by examiner

*Primary Examiner*—William M. Pierce
(74) *Attorney, Agent, or Firm*—R W Becker & Associates; R W Becker

(57) ABSTRACT

A pin for playing ninepins or for bowling is provided. The base portion of the pin is detachable from the pin body and is replaceable. The base portion comprises a material that is more robust, wear resistant and/or has a higher resistance to scoring than does the remainder of the pin. The base portion can be provided with a reinforcement. The base portion has an annular support surface with at least one radially extending notch, a sharp inner edge, and high static friction to effect an improved ground adhesion.

11 Claims, 1 Drawing Sheet

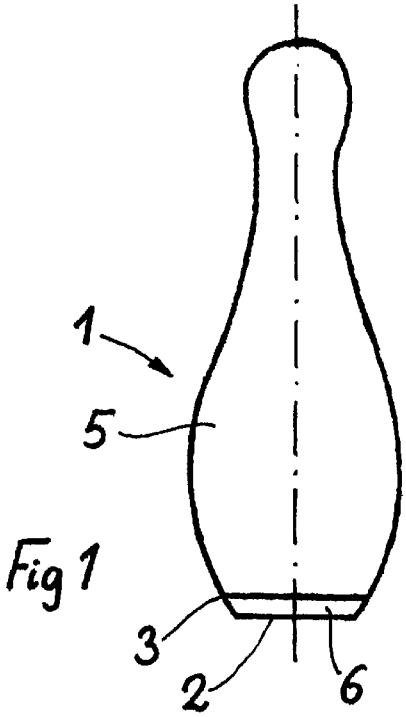
Fig 1
Fig 2
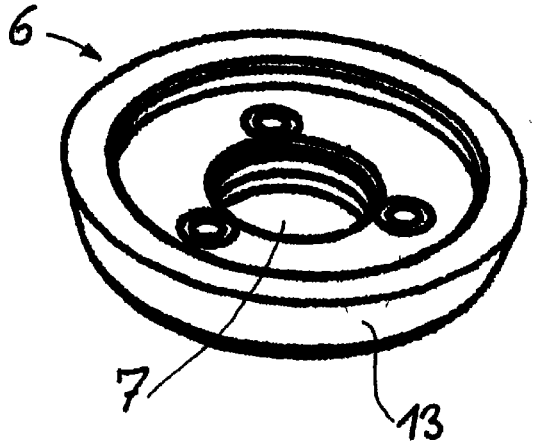
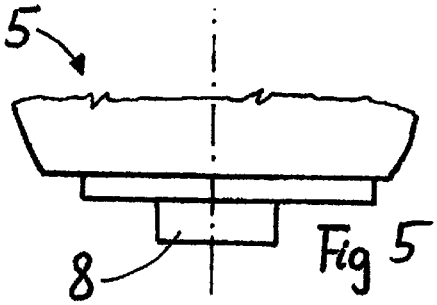
Fig 5
Fig 3
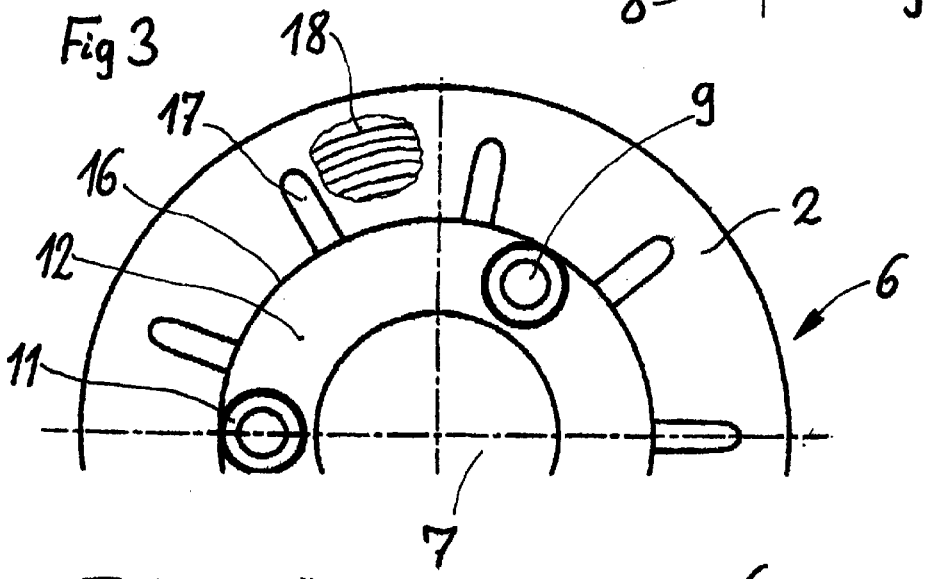
Fig 4
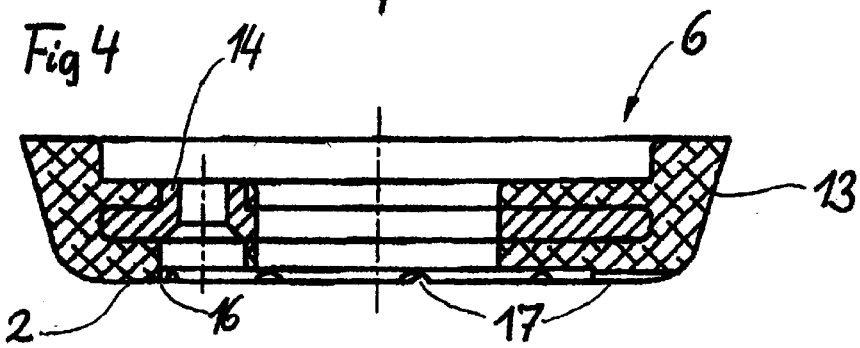

PIN FOR NINEPINS AND BOWLING

BACKGROUND OF THE INVENTION

The present invention relates to a pin for playing ninepins or for bowling.

Such a pin is subjected to wear over time, primarily due to the fact that during play it is struck by the ball and falls over. Such wear particularly affects the edge at the bottom of the pin between its outer surface and its support surface. This edge is greatly stressed since when the pin falls over, it routinely rolls over this edge and thereby a high surface pressure and friction occur on a small section. In addition to this, an edge is already subjected to greater wear than are round shapes, which conventionally determine the shape of a pin.

Due to the aforementioned wear, the edge becomes more round, which makes it easier for the pin to fall over. If certain portions of the edge become particularly worn, for example become scored, the character of the pin can be directionally dependent, i.e. the pin falls over when it is struck from a particular direction more easily than when it is struck from a different direction. However, since all pins should have the same characteristics, especially during tournaments, where very high requirements are set in this regard, wear of the edges of the pin can make the pin unusable, even if the rest of the pin is still satisfactory.

It is therefore an object of the present invention to provide a pin of the aforementioned general type that can be easily repaired if the base region becomes worn.

BRIEF DESCRIPTION OF THE DRAWING

This object, and other objects and advantages of the present invention, will appear more clearly from the following specification in conjunction with the accompanying schematic drawing, in which:

FIG. 1 is a side view of one exemplary embodiment of an inventive pin;

FIG. 2 is a perspective view of a replaceable base portion for the pin of FIG. 1;

FIG. 3 is a bottom view showing a portion of the support surface of the base of FIG. 2;

FIG. 4 is a cross-sectional view of the base of FIG. 2; and

FIG. 5 is a side view of the lower portion of the pin of FIG. 1 without a base.

SUMMARY OF THE INVENTION

The objective of the present invention is characterized primarily by a pin having a separate base portion that can be detachably connected with the pin body.

The base portion can thus be replaceable as an expendable part. It can be secured to the pin body by being screwed thereto. Pursuant to one advantageous specific embodiment of the present invention, the base portion is made of a material having a greater wear resistance and/or higher elasticity than does the pin body in conjunction with a high static friction. Possible materials for the base, which can be selected for adaptation to the respective requirements, are: PU casting resin, thermoplastic polyurethane, thermoplastic elastomers, hard thermoplastics such as PA, POM, PBT, and also rubber, preferably having shore hardnesses in the range of from 50A–90D. A plastic base can in addition be provided with reinforcements of a stiffer material, such as metal.

The present invention is particularly applicable for pins of plastic or polymeric material. However, the invention can also be useful for wooden pins. Pins in the context of this application are also known as so-called bowling pins.

The present invention also provides the possibility for giving the support surface of the pin a shape that favorably influences the characteristic of the pin without having to treat or otherwise process the entire pin.

When the pin is struck by the ball or another pin, it should not be shifted to the side while maintaining an upright position; rather, it should either fall over or remain standing in its original position. Such a characteristic of a pin is desirable not only for the course of play. When bowling or playing ninepins, such apparatus are generally used for the automatic setting of the pins that grasp the head of the pin with suitable gripping means. By means of such a machine, after the first ball has been thrown the pins that have not fallen over are raised, whereas the pins that have been knocked over are removed from the lane. However, if the pins have been pushed to the side from their original position, the machine can no longer grasp them. This results in an undesirable delay in play.

Pursuant to one advantageous specific embodiment of the present invention, the support surface has an annular or ring-shaped configuration and ends toward the inside with a sharp edge. The support surface can be provided with a profiling. In an advantageous manner, the annular support surface is interrupted by at least one radially extending groove or notch. As a result of these measures, it is not so easy for the pin to slide on its support surface.

The configuration of a pin is determined by generous contours and a smooth surface. With plastic pins, an outer shell is generally produced in a mold, for example by blow molding, with the interior being filled with a foam or cellular plastic. Fine structures on the support surface, as proposed here for improving the stability of the pin, can be provided only with difficulty, or only by additional complicated steps, on a conventional pin, the support surface of which is integrally formed on the pin body. However, the present invention provides the possibility of easily providing the pin with an optimally formed support surface.

Further specific features of the present invention will be described in detail subsequently.

DESCRIPTION OF PREFERRED EMBODIMENTS

Referring now to the drawing in detail, the pin 1 has the overall conventional shape, including a barrel-shaped bulge in the lower region, which merges in an upward direction via a narrow neck with a somewhat thicker head; the pin has a circular cross-sectional configuration. At the bottom, the pin 1 has a planar surface 2 that forms the support surface when the pin is placed upright, and which merges via an edge 3 into the outer surface of the pin 1.

The important thing is that the support surface 2 and the edge 3 are disposed on a portion, the base 6, that is produced separately from the actual pin body 5. This base 6 is detachably connected with the pin body 5.

The base 6 is provided in the middle with a centering bore or hole 7 that is placed upon a pin 8 at the bottom of the pin body 5. The base 6 is held on the pin body 5 via screws 9. In the embodiment illustrated in the drawing, three screws 9 are provided, which has shown to be advantageous. However, a different number of screws 9 could also be provided. The heads of the screws 9 are disposed in recesses 11 and 12. This prevents the stability of the pin 1 from being adversely affected by projecting screw heads.

The support surface 2 of the pin 1 is a narrow annular surface on the outer rim of the base 6. This annular surface merges via a radius into the side wall 13 of the base 6. The edge 3 is thus slightly rounded. The side wall 13 of the base 6 is adapted to the shape of the pin 1. The outer surface of the pin body 5 adjoins the side wall 13 in a continuous or stepless manner.

Disposed in the plastic base 6 is a reinforcing plate 14 that is made of plastic reinforced with metal or glass fibers (GfK). When viewed in plan, the reinforcing plate 14 has a ring-shaped configuration and is reinforced at those locations where the screws 9 pass through it. The reinforcing plate 14 is intended to prevent the base 6 from warping and not resting flushly against the pin body 5, which would cause a gap between the side wall 13 of the base and the pin body 5, or could even cause unevenness of the support surface 2. Due to the weight of the reinforcing plate 14, it is also possible to influence the center of gravity of the pin. As a consequence of the heavy reinforcing plate, it is possible to achieve a low center of gravity for the pin, which is particularly valued by professional bowlers. The reinforcing plate 14 and the base 6 can be interconnected to form a unit by placing the reinforcing plate 14 into the mold used for manufacturing the base 6 by injection molding and embedding the plate with the plastic or polymeric material.

The inner side of the support surface 2 is delimited by a sharp edge 16 which is adjoined by the similarly ring-shaped surface 12 that is recessed relative to the support surface 2.

The playing surfaces of ninepin and bowling lanes are conventionally made of wood and are treated with oil. This produces on the lane an oil film, albeit a very thin oil film, that enhances a sliding of the pin and hence the undesired lateral shifting of the pin. The edge 16 acts as an interruption or breaking edge which, in a manner similar to that achieved with vehicle tires by edges and grooves, prevents the support surface from floating upon the oil film.

The support surface 2 is in addition interrupted by at least one groove or notch 17. On the one hand, this reduces the actual support surface, the positive profiled region, and thus increases the pressure per unit of area of the support surface when the pin is upright. In addition, by means of the notches 17 air can escape that otherwise would be occluded below the surface 2 and could effect a slight sliding of the pin as a consequence of an air cushion type of effect. At least one notch 17 is required for venting this air cushion effect. In an advantageous manner, six to twelve, and preferably nine of these venting notches 17 are provided.

The support surface 2 can furthermore be provided with furrows 18 that extend in the circumferential direction. In FIG. 3, such furrows are indicated merely for a portion of the support surface.

Due to the presence of the sharp edge 16, the venting notches 17 and the furrows 18, as well as due to the fact that the support surface 2 is a narrow ring-shaped surface, the pin 1 stays securely in place and does not slide. The undesired lateral shifting of an upright pin can thus be prevented to a large extent. By selecting one of the aforementioned materials for the base 6, it is furthermore possible to favorably affect the stability of the pin 1.

The specification incorporates by reference the disclosure of German priority document 101 06 101.1 filed Feb. 8, 2001.

The present invention is, of course, in no way restricted to the specific disclosure of the specification and drawings, but also encompasses any modifications within the scope of the appended claims.

I claim:

1. A pin for playing ninepins or for bowling, comprising:

a pin body, and a separate base portion that is detachably connected to said pin body, wherein said base portion is provided with a support surface for said pin, wherein said base portion is provided with a profiling that makes a shifting of said pin on said support surface more difficult, and wherein a plurality of radially extending notches are provided in said support surface.

2. A pin according to claim 1, wherein said base portion is, relative to said pin body, at least one of more robust, more wear resistant, and more resistant to scoring.

3. A pin according to claim 1, wherein said base portion is made at least primarily of polymeric material.

4. A pin according to claim 3, wherein a plate made of a material that is stiffer than that of said base portion is disposed in said base portion.

5. A pin according to claim 4, wherein said plate is made of metal.

6. A pin according to claim 1, wherein said base portion is adapted to be held on said pin body via screws.

7. A pin according to claim 1, wherein said pin body is provided with a projection, and wherein a central portion of said base portion is provided with a centering bore that is placeable upon said projection.

8. A pin according to claim 1, wherein said support surface is a circular ring that is delimited inwardly by a sharp edge.

9. A pin for playing ninepins or for bowling, comprising:

a pin body, and a separate base portion that is detachably connected to said pin body, wherein said base portion is provided with a support surface for said pin, wherein said base portion is provided with a profiling that makes a shifting of said pin on said support surface more difficult, and wherein said support surface is provided with at least one radially extending notch.

10. A pin according to claim 9, wherein a plurality of radially extending notches are provided.

11. A pin for playing ninepins or for bowling, comprising:

a pin body, and a separate base portion that is detachably connected to said pin body, wherein said base portion is provided with a support surface for said pin, wherein said base portion is provided with a profiling that makes a shifting of said pin on said support surface more difficult, and wherein said support surface is provided with a profiling that is formed by a plurality of approximately circumferentially extending furrows.

* * * * *